US006370351B1

(12) United States Patent
Puritscher et al.

(10) Patent No.: US 6,370,351 B1
(45) Date of Patent: Apr. 9, 2002

(54) DEVICE FOR TRANSPORTING A BAND-SHAPED RECORDING MEDIUM IN AN ELECTROGRAPHIC PRINTING OR COPYING UNIT

(75) Inventors: Ernst Puritscher, Unterhaching; Friedrich Meschenmoser, Grasbrunn, both of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/554,415

(22) PCT Filed: Nov. 5, 1998

(86) PCT No.: PCT/EP98/07062

§ 371 Date: Jul. 17, 2000

§ 102(e) Date: Jul. 17, 2000

(87) PCT Pub. No.: WO99/24875

PCT Pub. Date: May 20, 1999

(30) Foreign Application Priority Data

Nov. 10, 1997 (DE) ..... 197 49 651

(51) Int. Cl.[7] ..... G03G 21/16

(52) U.S. Cl. ..... 399/313; 399/384; 399/312; 399/121; 399/124

(58) Field of Search ..... 399/384, 310, 399/311, 312, 313, 121, 124, 126

(56) References Cited

U.S. PATENT DOCUMENTS

| | | | | | |
|---|---|---|---|---|---|
| 4,268,163 | A | * | 5/1981 | Doi et al. | 399/121 |
| 4,642,661 | A | | 2/1987 | Dean, II | 347/152 |
| 6,029,020 | A | * | 2/2000 | Blackman et al. | 399/45 |
| 6,118,956 | A | * | 9/2000 | Hirao | 399/85 |
| 6,256,474 | B1 | * | 7/2001 | Gibisch et al. | 399/384 |

FOREIGN PATENT DOCUMENTS

| | | |
|---|---|---|
| DE | 42 14 126 A1 | 11/1992 |
| EP | 0 399 287 | 11/1990 |
| WO | WO 95/19929 | 7/1995 |

* cited by examiner

*Primary Examiner*—Daniel J. Colilla
(74) *Attorney, Agent, or Firm*—Schiff Hardin & Waite

(57) ABSTRACT

An apparatus for transporting web-shaped recording media through an electrographic printer or copier has a support member which supports driving and guiding elements. The support is pivotally mounted in the housing via a support shaft. The recording medium is transported by friction by a drive roller mounted on the support, the recording medium being pressed against the toner carrier by a pressing member. The supporting shaft and the drive roller run in a coaxial manner.

12 Claims, 12 Drawing Sheets

DEVICE FOR TRANSPORTING A BAND-SHAPED RECORDING MEDIUM IN AN ELECTROGRAPHIC PRINTING OR COPYING UNIT

BACKGROUND OF THE INVENTION

1. Field of the Invention

The present invention is directed to a means for transporting a web-shaped recording medium in an electrographic printer or copier device.

2. Description of the Related Art

In printer devices of this species, the recording media are transported along a printing station and printed thereat. As needed, the recording medium is thereby composed of paper, of plastic film material or of other materials as well. The recording medium is printed over a specific width in the transfer printing station of such devices.

Dependent on the embodiment of the printer device, single sheets, roll goods with margin perforation or roll goods without margin perforation can be printed. Whereas paper with lateral holes for transport and position monitoring of the paper is employed in many applications, paper grades that exhibit no such margin perforation but are nonetheless fabricated as roll goods or fanfold paper are also increasingly employed.

Published International Patent Application WO 95/19929 A1 discloses a printer that can process roll paper without margin perforation as well as with margin perforation. A first seating edge, which prescribes the lateral position of the paper, as well as stabilization rollers, an under-pressure brake and a roller arrangement with a loop-drawing means are provided in this printer for the exact guidance.

Given printers of this type, there is often the problem that the paper transport unit must be disassembled for service purposes. For example, it regularly occurs that what is referred to as a corotron wire breaks during printing operation and a new corotron wire must be introduced. When such a service instance occurs during printing operation, then it is desirable to return the paper into the same position after the service action that it was in previously. Otherwise, a relatively complicated procedure must be started in order to restart the printing operation, whereby it is usually necessary to reprint various pages. Not only does excess printed matter (maculature) arise as a result thereof, additional outlay for sorting the reprinted paper out is also incurred.

European Patent document EP 0 399 287 A2 discloses a device for transporting a web-shaped recording medium in an electrographic printer or copier device. The carrier shaft and the drum for transporting the web-shaped material are arranged essentially coaxially.

German Patent document DE 42 14 126 A1 discloses an apparatus wherein a carrier is seated pivotable around a drum axis. The carrier is pivotable together with the drive drum and a contact pressure drum.

U.S. Pat. No. 4,642,661 discloses a transport mechanism for a web-shaped recording medium in a printer device, whereby transport and contact pressure elements of a pin feed wheel or, respectively, tractor drive are arranged at a carrier. The transport and contact pressure elements can be swivelled around an axis together with the carrier, whereby the drive shaft of the tractor proceeds concentrically relative to the swivelling axis of the carrier.

SUMMARY OF THE INVENTION

It is an object of the present invention to provide a means for transporting a web-shaped recording medium in an electrographic printer or copier device with which a positionally exact printing is also retained in the region of the transport unit after a service call.

This object is achieved by the apparatus described with the features of a carrier carrying a plurality of drive and guide elements, the carrier being pivotably seated at the housing of the printer or copier device via a carrier shaft and being capable of being pivoted back and forth between a working position and a service position; a drive drum seated at the carrier, the recording medium being transported by the drive drum with friction and the drum proceeding coaxially with the carrier shaft; contact pressure means with which the recording medium is pressed against a toner transfer means, particularly against a photoconductor drum, in the transfer printing area of the printer or copier device; and a means with which a retaining moment can be transmitted onto the recording medium during the pivot motion for stabilizing the position of the recording medium relative to the drive drum, and by the method for transporting a web shaped recording medium in an electrographic printer or copier device, including a carrier carrying a plurality of drive and guide elements is provided, the carrier being pivotably seated at the housing of the priner or copier device via a carrier shaft and being capable of being pivoted back and forth between a working position and a service psoition; a drive drum seated at the carrier is provided, the recording medium being transported by the drive drum with friction and the drum proceeding coaxially with the carrier shaft; contact pressure means with which the recording medium is pressed against a toner transfer means, particularly against a photoconductor drum, in the transfer printing area of the printer or copier device; are provided; and a retaining moment is transmitted onto the recording medium during the pivot motion for stabilizing the position of the recording medium relative to the drive drum. Advantageous exemplary embodiments of the invention provide a lock mechanism with which the means can be locked in a working position at the housing of the printer or copier device; and means for power support with which the means can be brought into a service position in the unlocked condition. In a preferred embodiment, the means for power support comprise a gas compression spring. The gas compression spring is rotatably seated at the carrier at a first bearing point and at a second bearing point at a bearing block that is rigidly connected to the device housing. The drive drum is driven by a stepping motor, whereby the stepping motor is under power for exerting the retaining moment while the means is being pivoted from a working position into a service position and back into the working position. In one embodiment, the stepping motor is mounted at the carrier. A first adjustable detent is provided at the bearing block for adjustment of the means relative to the device housing along a first direction and a second adjustable detent is provided for adjustment of the means relative to the device housing along a second direction. The drive drum may interact with counter-pressure rollers that press against the drive drum with an adjustable spring power. Preferably, the drive drum is seated on the carrier shaft.

Inventively, the means for transporting a web-shaped recording medium in an electrographic printer or copier device comprises a carrier, which is pivotably seated via a carrier shaft at the housing of the printer or copier device, as well as a drive drum with which the recording medium is transported by friction. The drive drum is rotatably seated at the carrier. Further, pressing means are provided with which the recording medium is pressed against a toner transfer means in the transfer printing area of the printer or copier device. The carrier shaft and the drive drum proceed coaxially. As a result thereof, the position of the drive and guide elements mounted at the unit is retained relative to the paper given a pivot motion of the means or, respectively, of the drive unit. It is particularly provided for this purpose that the drive drum is driven by a stepping motor, whereby the stepping motor is placed under power while the means is pivoted from a working position into a service position and back into the working position. As a result thereof, a retaining moment is transmitted onto the paper web, this stabilizing the relative paper position during the pivot motions.

In particular, the drive drum is seated in the carrier shaft around which the unit is pivotable. As a result thereof, an especially exact allocation between paper and drive drum is assured during the swivel motion.

What the invention also effects is that the paper transport can be pivoted back and forth between a working position and a service position such that the relative position of the paper in the working position practically does not change with respect to device-fixed units such as the transfer printing station.

At least one adjustable detent is provided at a bearing block of the means for adjusting the drive unit relative to the housing of the printer.

BRIEF DESCRIPTION OF THE DRAWINGS

Exemplary embodiments of the invention are explained in greater detail below with reference to some Figures.

DETAILED DESCRIPTION OF THE PREFERRED EMBODIMENTS

Figure 1:
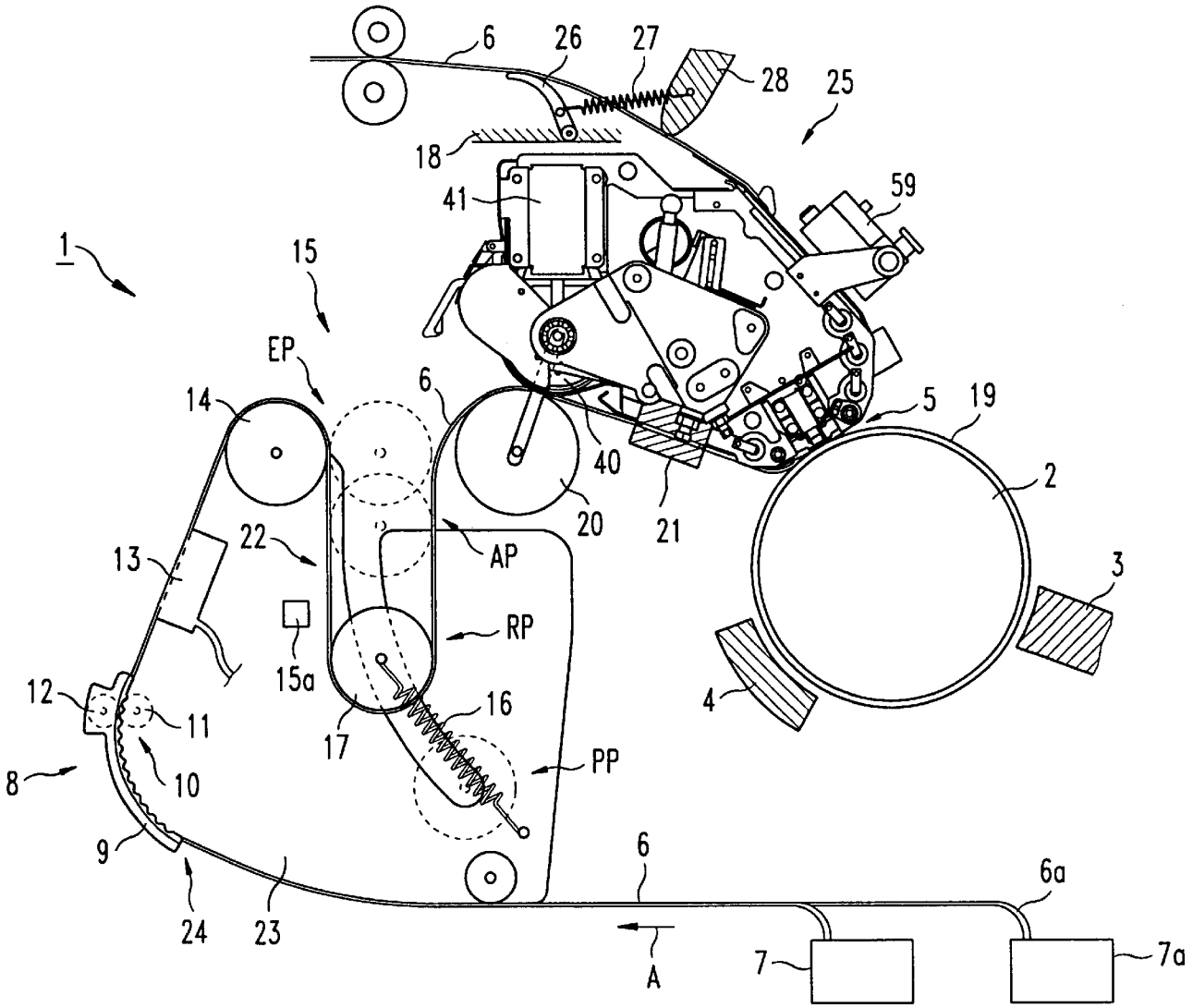
FIG. 1 is a side section view showing the paper running within an electrophotographic printer.

The paper transport means 1 shown in FIG. 1 conveys a paper web 6 from a paper supply 7 via a pre-centering means 8 and a drive unit 25 to a transfer printing station 5. Thereat, the paper 6 accepts toner from the surface 19 of a photoconductor drum 2, this toner having been applied onto the photoconductor drum 2 in the developer station 4. The information that is thereby transferred corresponds to the latent image information written on the photoconductor drum 2 with the character generator 3.

Overall, the paper transport corresponds to the arrangement disclosed by International Published Application WO 95/19229. The content thereof is herewith incorporated into the present specification by reference.

In the pre-centering means 8, the paper web 6 is deflected by approximately 90° in the region of a detent plate 9. This region forms a deflection path 24. The paper web 6 is thereby conducted through between a roller arrangement 10, whereby both the lower rollers 11 as well as the upper rollers 12 are placed at a slant relative to the paper transport direction A, so that the rollers 11, 12 exert a force perpendicular to the transport direction A onto the paper web 6 with their rotational movement. The paper web 6 is thereby pressed against the detent plate 9, an adequately precise guidance being thus assured. The upper rollers 12 are, in particular, seated pivotable away from the common profile carrier 23, so that a new paper web can be easily introduced between the rollers 11, 12.

After the pre-centering in the deflection path 24, the paper web 6 passes through a paper brake 13. The braking effect thereof is based on an under-pressure with which the paper web 6 is drawn against an under-pressure chamber and thus decelerated. A tension is generated in the paper web 6 due to this braking.

Subsequently, the paper web 6 is supplied to a first loop-drawing means 15 by a deflection roller 14. The loop-drawing means 15 is essentially composed of a movably seated roller 17 that is pulled by a spring 16 opposite the paper tension. A paper supply loop 22 arises as a result thereof. The paper web 6 wraps the roller 17 by approximately 180°, as a result whereof it is stabilized perpendicular to the transport direction A. The roller 17 is implemented as a lightweight structure. Its core, however, is composed of stiff material, for example of carbon fiber-reinforced plastic (CFK), in order to minimize elastic spring effects within the roller 17. The loop-drawing means 15 and the under-pressure brake 13 form a regulating system that produces a constant tension of the paper web 6 from the under-pressure brake 13 to beyond the transfer printing station 5. Magneto-resistive sensors 15*a* thereby sense the position of the roller 17. During printings operations, the roller 17 is held as constantly as possible in a working position AP. The spring 16 has an exactly defined work area in a narrow range. The sensors 15*a* are arranged in this region around the working position AP in high-resolution fashion with eight measuring points. The under-pressure in the brake 13 is then set such that the roller positions deviate as little as possible from a rated, or target, position.

The roller 17 is in an upper insertion position EP for inserting a new paper web 6. During a print stop (for example, when the drive unit 25 is pivoted away from the photoconductor drum), the roller 17 is in the pull-back position RP, whereby the loop 22 is larger than in the working position AP. When the paper web 6 tears, then the roller 17 moves into the lower position PP. One of the sensors 15*a* detects this event and forwards a corresponding error message to the system controller.

Following the loop-drawing means 15, the paper web 6 is supplied to the drive unit 25. Contact pressure rollers 20 press the paper web 6 against an drive drum 40 of the input side that drives the paper web 6 in the direction of the transfer printing station 5. Before the paper web 6 reaches the transfer printing station, it is opto-electronically sensed with a paper width sensor 21. Details of this sensor are described in FIG. 9 as well as in German Patent Document DE-U-297 23 879 (assignee's case number: 97 1101).

After the paper web 6 has passed through the transfer printing station 5, it is supplied by the drive unit 25 to a second loop-drawing means 26 that is acted on by the tension of a spring 27 that is seated at a housing projection 28 of the printer housing 18. After passing the second loop-drawing means 26, the paper web 6 can be supplied to further units, for example a known fixing means wherein the toner image is fixed on the paper web 6.

The exemplary embodiment that has just been described assumes that only one paper web 6 is transported through the transfer printing station. In a second exemplary embodiment, it can just as easily be provided that two paper webs 6 and 6*a* lying side-by-side are simultaneously transported through the transfer printing station 5. The second paper web 6*a* would thereby be taken from a second paper supply 7*a*. All paper guidance and paper transport elements as well as the transfer printing station and the photoconductor drum 2 would be adapted in view of their geometrical dimensions such that the two paper webs 6 and 6*a* can pass through the transfer printing station 5 side-by-side. The arrangement of the paper web and of the transport devices can thereby ensue as in Published International Application WO-A-96/03282.

The paper transport means is uniformly referenced with A in the Figure descriptions that now follow. The other reference characters have also been retained insofar as the same or, respectively, structurally identical elements are involved in the following Figures.

Figure 2A:
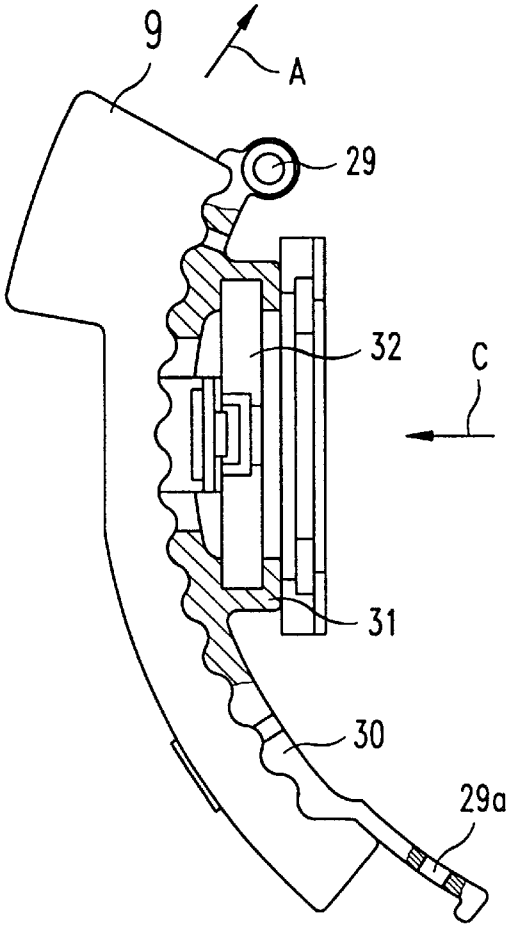
FIG. 2 guide elements for paper guidance.

The detent plate 9 of the pre-centering means 8 is shown in greater detail in FIG. 2*a*. It is firmly seated on a slide rail 32 that is seated displaceable along a corrugated profile plate 30. To this end, the corrugated profile plate 30 is equipped with guide profiles 31 in the region of the slide rail 32, so that the slide rail 32 is displaceable perpendicular to the direction C. The guide plate 9 also shifts together with the displacement of the slide rail 32. The corrugated profile 30 is to be secured to the profile carrier 23 of the pre-centering means 8 with a suspension 29 as well as through screw openings 29*a*. The guide plate 9 prescribes the lateral guidance of the paper web 6 in the entire paper run (FIG. 1). As disclosed by Published International Application WO-A-95/19929, braking device 13 and loops 22, and 15 effect such a great stabilization of the paper web 6 that it no longer deviates from this laterally stable attitude up to the transfer printing area 5. The guide plate 9 is thus the determinant lateral guidance element for the paper web 6 within the overall paper transport arrangement.

Figure 2B:
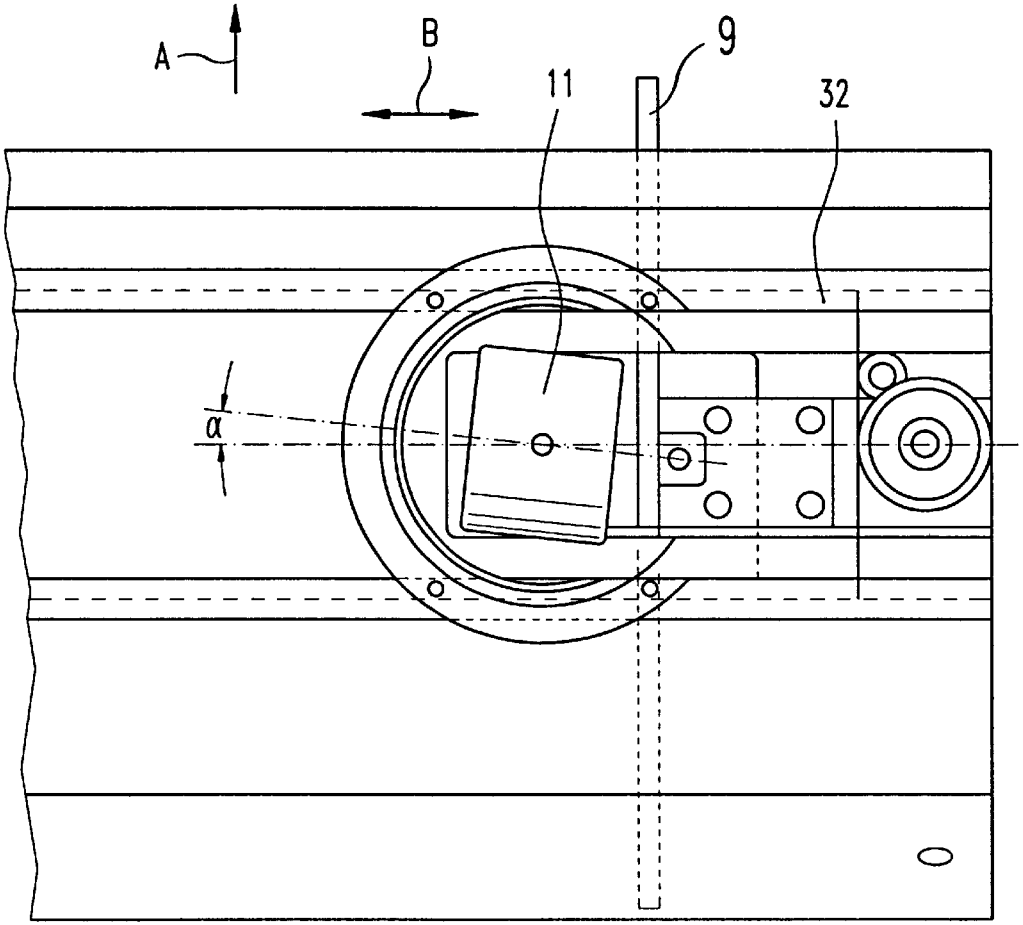

Both roll material having lateral margin perforations as well as roll material without lateral margin perforations can be transported with the described paper a transport because the transport ensues only with friction. What is of concern in the region of the transfer printing station 5 is that, dependent on the type of paper inserted (with/without margin perforations), the printable region of the paper comes to lie in a specific region of the photoconductor drum. Accordingly, it can be necessary to adapt the lateral guide plate 9 to the type of paper, i.e. to modify the position of the guide plate 9 perpendicular to the paper transport direction A. This can ensue by shifting the guide plate 9 with the slide rail 32 within the guide recess 31 along the direction B. FIG. 2*b* shows the view C of FIG. 2*a*. The detent plate 9 is thereby displaceable along direction B together with the slide rail 32. The lower ball bearing roller 11 is thereby also shifted, so that the relative position between ball bearing 11 and detent plate 9 is preserved.

The ball bearing roller 11 is inclined at an acute angle $\alpha$ of approximately 6° with respect to the direction B. What this effects is that paper that is moving in transport direction A experience a frictional force transversely relative to the transport direction ((in direction B). As a result thereof, the paper web is automatically guided along the detent plate 9.

Figure 3:
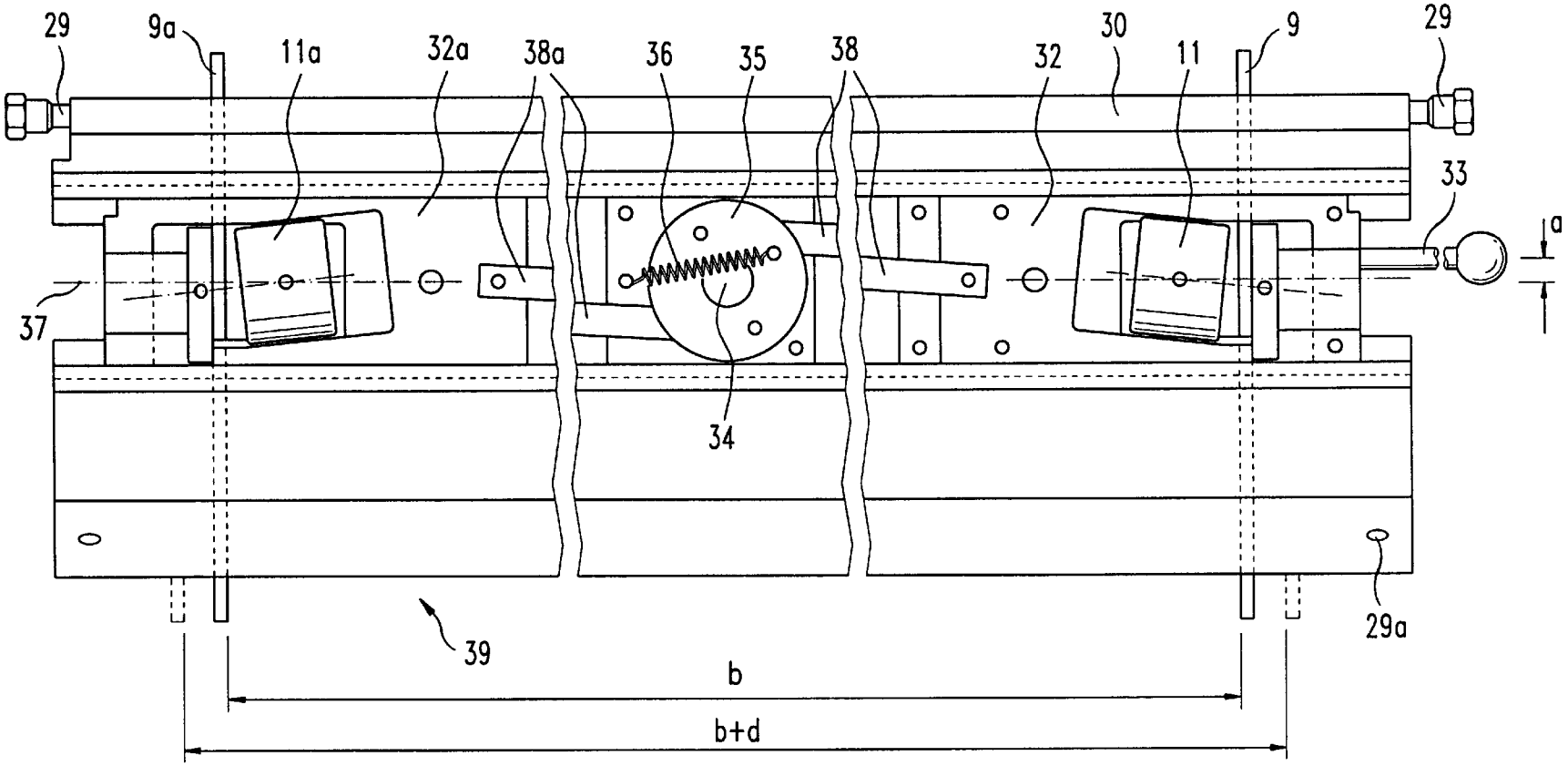
FIG. 3 is a side view of an adjustment mechanism for the guide elements.

FIG. 3 shows a specific exemplary embodiment for a setting of two detent plates 9 and 9*a*. The front detent plate 9 with the ball bearing roller 11 is thereby shifted as described in FIGS. 2*a* and 2*b*. The displacement ensues with a lever 33 that attacks eccentrically at a sheave 35. The offset between the mid-point 34 of the sheave 35 or, respectively, the transverse axis 37 and the lever 33 amounts to the spacing 'a'. By moving the lever 33 along the axis 37, the sheave 35 turns and entrains a rodding 38 with which the slide rail 32 moves along the axis 37. The connecting lever 38 is likewise eccentrically mounted on the sheave 35 for this purpose.

A back guide plate 9*a* with slide rail 32*a* and ball bearing roller 11*a* is mounted at the opposite side of the sheave 35 practically mirror-inverted relative to the units 9, 32 and 11 such that the two detent plates 9 and 9*a* move oppositely when the lever 33 is moved along axis 37.

The embodiment described in FIG. 3 for displacing the two detents 9 and 9*a* is employed when, according to FIG. 1, two paper webs 6 and 6*a* pass through the transfer printing station 5. What is enabled as a result thereof is that the two paper webs are allocated center-symmetrically to the transfer printing station 5 and, thus, to the print image. In particular, it is provided to adjust the detents 9 and 9*a* by respectively half an inch, so that the entire width of the paper guidance channel is adjusted by one inch. The paper running edge that has been set can thereby be monitored with a sensor. Further, a malfunction message ensues in the control panel of the electronic device controller when the position of the paper web or, respectively, paper webs does not correspond to a predetermined rated value.

The adjustment means shown in FIG. 3 has two stable conditions. The two guide plates 9 and 9*a* have the spacing b in the first condition, and the spacing b+d in the second condition. The adjustment width d derives from the different papers employed. Paper with margin perforations is usually about one inch =2.56 cm wider than comparable paper without margin perforations. The width of the paper channel 39 must be set accordingly. The adjustment mechanism shown in FIG. 3 has two stable conditions. It is held under pre-stress for this purpose by a spring 36 rigidly mounted at the device. What the connecting rods 38 and 38*a* with appertaining slide rails 32 and 32*a* effect is that the sheave 35 can only turn within the range prescribed by the free range of motion of the slide rails 32 and 32*a*. The tension spring 36 is thereby secured on the shaft 37 on the base plate 30 center-symmetrically relative to the sheave 35.

Figure 4:
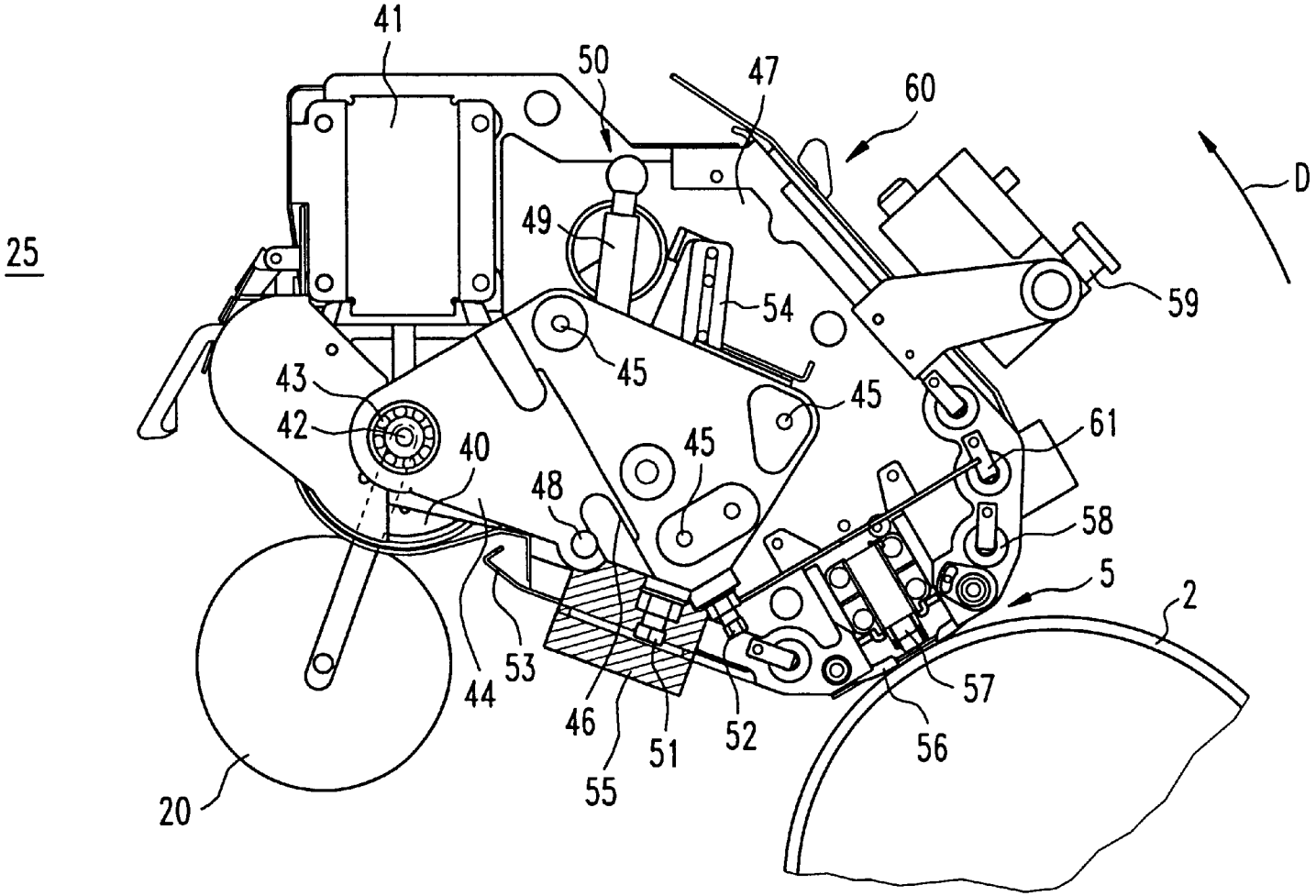
FIG. 4 is a cross sectional view of a paper transport means in the region of a transfer printing station.

FIG. 4 shows the drive unit 25 in a condition in which it lies against the photoconductor drum 2. A roller arrangement 20 presses against the drive drum 40 with predetermined spring force. As a result thereof, the paper web 6 which is transported through between the drums 40 and 20 is moved by the drive drum 40 on the basis of a friction lock. The drive drum 40 is in turn connected to the stepping motor 41 via a toothed belt drive. The entire drive unit 25 is flanged to a printer housing via a bearing block 44. A common bearing axis 42 is seated at the bearing block 44 by the ball bearing 43, the common bearing axis accepting both the rotational motion of the drive drum 40 and enabling a swivel motion of the drive elements around the swivelling axis B. In order to enable the swivel motion, the drive components such as motor 41, deflection rollers 58 and swivel jaws 56 are mounted on a carrier plate 47 that is connected to the bearing block 44 via a gas compression spring 49 as well as via the bearing axis 42.

Threads 45 located in the bearing block 44 serve for the acceptance of fastening screws with which the bearing block 44 is secured to the printer housing 18. The entire drive unit is adjustable within the printer housing 18 via guide surfaces 46. The carrier plate 47 is in turn adjustable relative to the bearing block 44, whereby a first adjustment screw 51 and a second adjustment screw 52 against which cylinder pins at the carrier side strike are provided in the bearing block 44.

The gas compression spring 49 is connected to the carrier 47 by the screw connection 50 and is connected to the bearing block 44 by the screw connection 48. The carrier 47 and the bearing block 44 can be locked relative to one another with the locking means 54.

A paper web 6 that is introduced into the drive unit 25 between the drive drum 40 and the counter-pressure drum 20 is guided to a paper sensor 55 by a guide plate 53. The paper sensor 55 senses the paper 6 over the entire width of the printable region of the photoconductor drum 2. As a result thereof, both the lateral paper edges as well as potential margin perforations of the paper web 6 can be recognized. In the region of the transfer printing zone 5 of the printer unit, the paper 6 is pressed against the surface 19 of the photoconductor drum 2 by the spring-seated swivel jaws 56. A known corotron means 57 generates a high-voltage with which the toner located on the photoconductor drum 2 is drawn to the paper 6. The deflection rollers 58 forward the paper 6 to a mark sensor 59 that recognizes any printing or cutting marks that may be present on the paper web 6. Grounded electrical connections 61 (anti-static plates) carry off any residual electrical charges located on the paper 5.

When margin perforated paper 6 is transported with the paper transport, the margin perforations can be sensed with a pin feed wheel 60.

Figure 5:
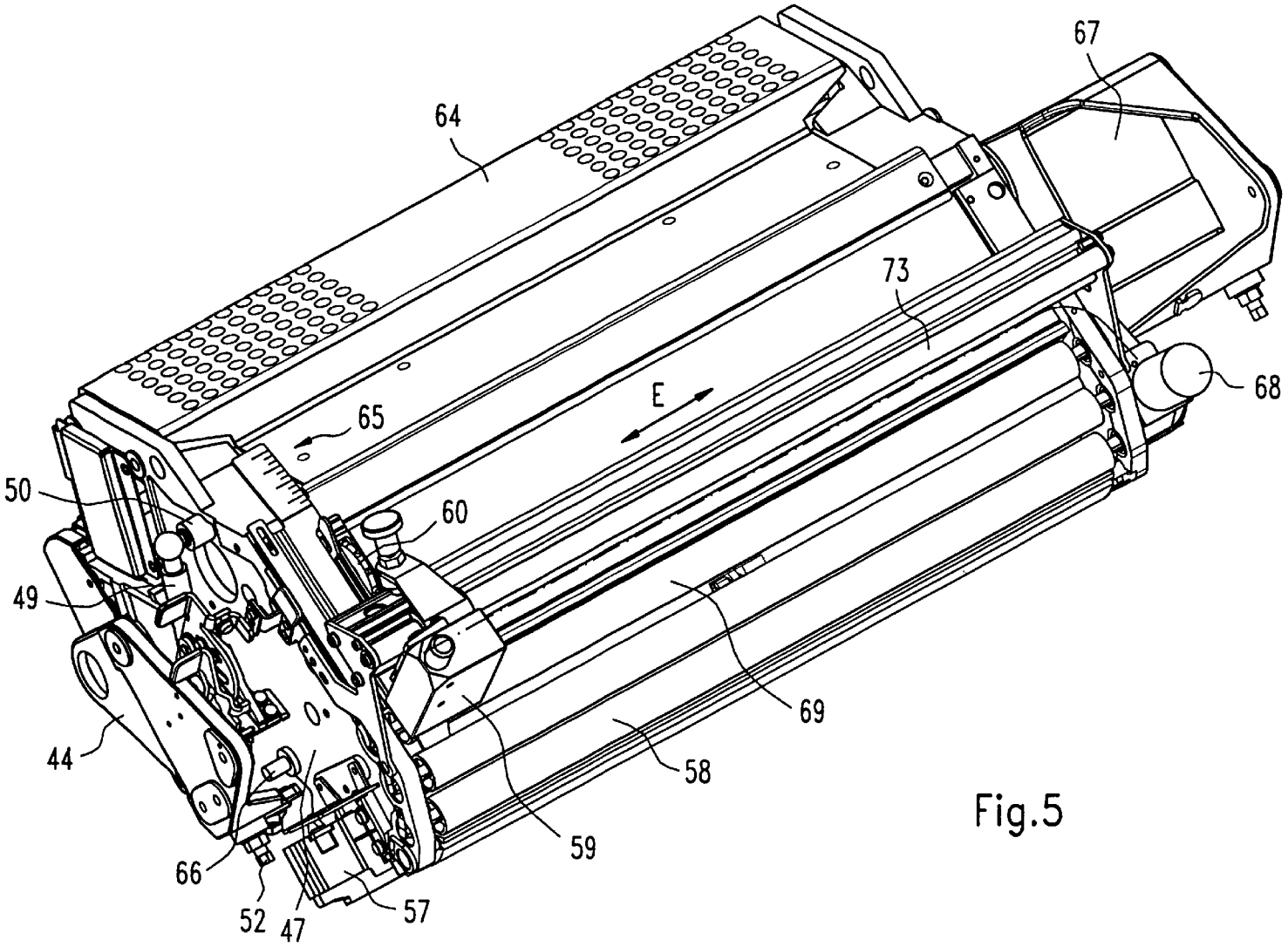
FIG. 5 is a perspective view of the paper transport means.

FIG. 5 shows a three-dimensional illustration of the paper drive 25. In particular, the cylinder pin 66 mounted at the carrier plate 47 that interacts with the adjustment screw 52 screwed in the bearing block 44 as well as the screw connection of the gas compression spring 49 can be seen therefrom.

The paper 6 is guided by a guide surface 69 above the deflection drums 58. The sensing of the paper 6 with the mark sensor 59 also ensues in this region. Further, a seating rule 65 is provided in this region, this being employed for the printer start. Newly inserted paper 6 that comprises margin perforations thereby has a page start placed against a marking of the rule 65 that corresponds to the page length, the margin perforation is brought into engagement with the pin wire 60, and the printing operation is initiated.

In the transfer printing area, a drive motor 68 pulls a corotron wire from the corotron wire cassette 57 according to the page width to be printed. The mark sensor 59 is displaceable in the direction E along the rod 73. The plate 64 covers the drive motor 41 and serves, in particular, as electromagnetic shielding. Corresponding to the front bearing block 44, a back bearing block 67 is also provided, this being likewise secured to the printer housing.

Figure 6:
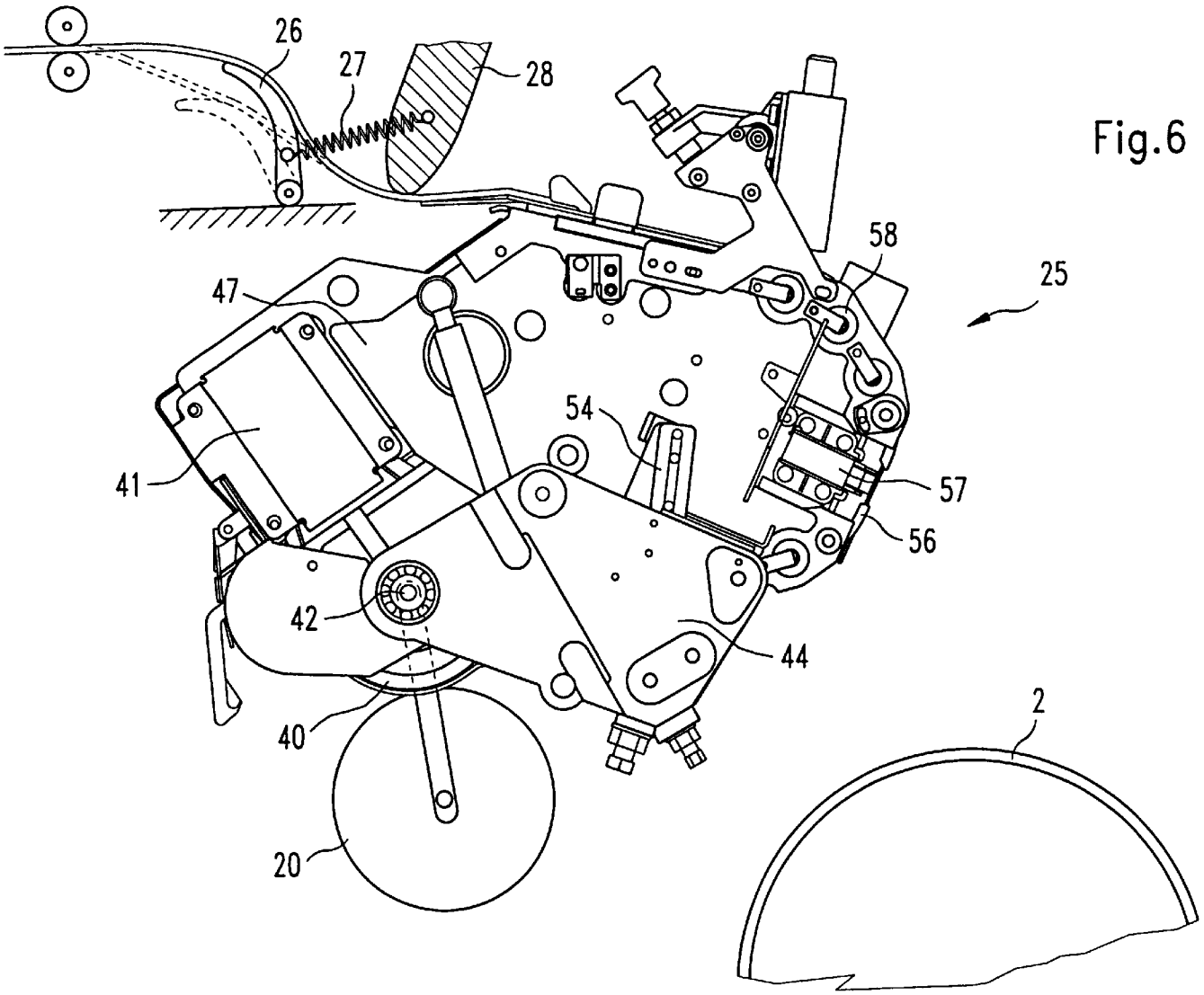
FIG. 6 is a side view of the paper transport means in a pivoted-out condition.

The lock mechanism 54 merely has to be unlocked in order to move the drive unit 25 from the operating position (FIG. 4) into the service position (FIG. 6). Due to the upwardly acting force of the gas compression spring 49, the drive unit 25 then automatically pivots up. The operator need exert practically no force. The carrier plate 47 together with all parts mounted at it thereby pivots around the drive or swivelling axis 42 relative to the bearing block 44 or, respectively, relative to the printer housing. The counter-pressure roller 20 thereby also pivots along, so that the paper 6 clamped between drive roller 40 and counter-pressure roller 20 executes no relative motion. The stepping motor 41 remains under power during the pivot event, so that it exerts a retaining moment on the drive roller 40. Due to the common bearing of the drive roller 40 and the carrier plate 47 in the shaft 42, no relative motion derives between the drive roller 40 and the other components mounted at the carrier 47, such as the swivel jaws 56 and the deflection rollers 58. As a result thereof, the clamped paper remains lying attitudinally exact at the drive unit 25. A potential paper compensation required with respect to following units of the printer ensues with the loop-drawing means 26. The loop drawing means 15 can effect a paper compensation relative to the pre-centering means 8. The loop-drawing means 26 is pivoted up in the example of FIG. 6, so that it accepts a length of paper becoming free when the unit 25 pivots up and forms a loop relative to the paper position (shown with broken lines) of the working position.

When, after the service work has been carried out, the drive unit 25 is in turn pivoted back into the working position, then the loop-drawing means 26 gives the stored length of paper back, so that the paper 6 subsequently comes to lie again in exactly the same position with respect to the other printer units, particularly with respect to the photoconductor drum 2, as in the working position before being swivelled up. As a result thereof, it is possible to resume an uninterrupted printing event with exact attitude.

Figure 7:
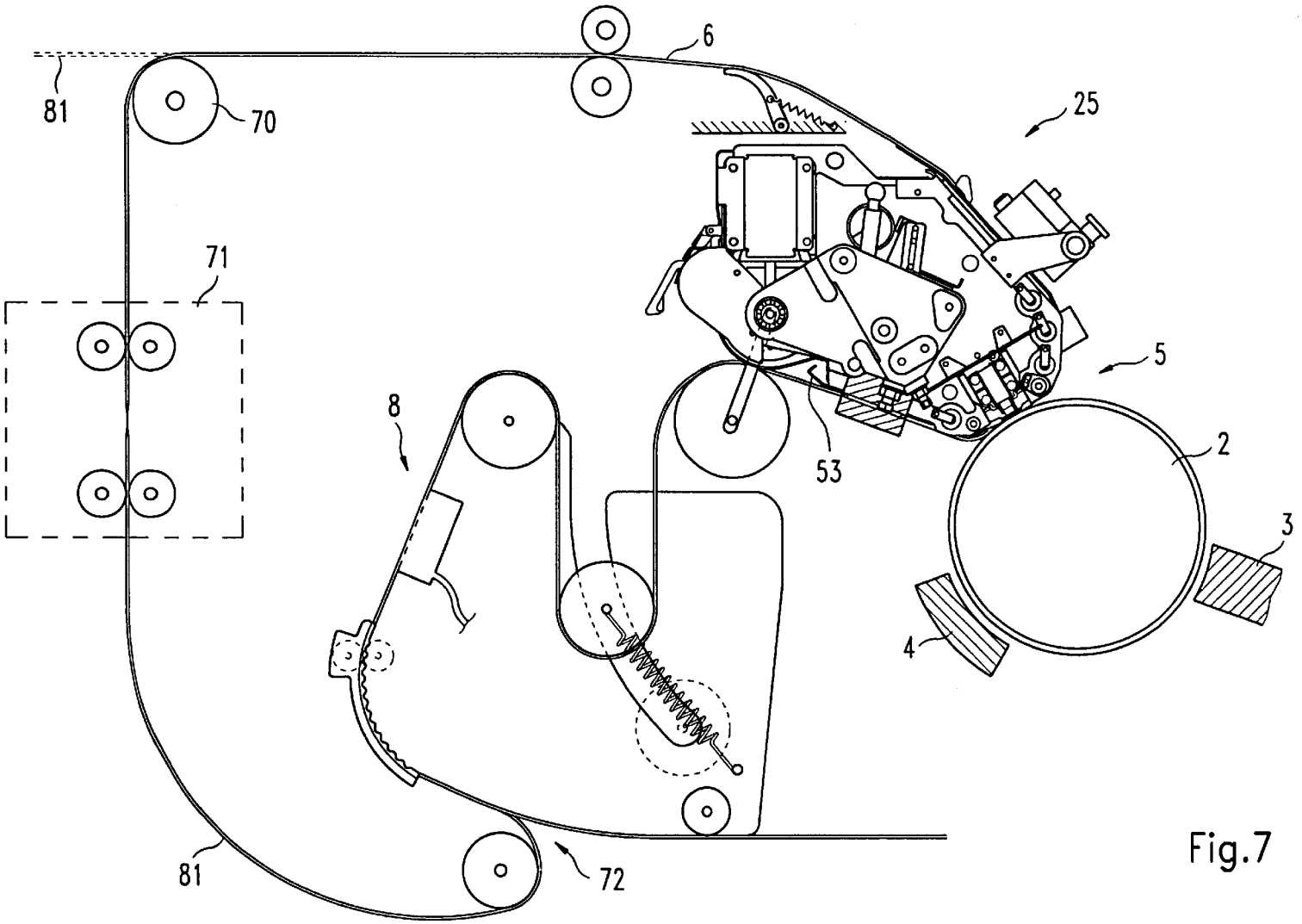
FIG. 7 is a side view of the paper running in a parallel printer device.

FIG. 7 shows a specific embodiment of the invention wherein a paper web 6, after the printing of the side, is supplied to a turnover station 71 via a deflection roller 70. The paper that has been turned over is thereby re-supplied to the pre-centering means 8 at a station 72. The paper web 81 that has been turned over thereby lies page-offset relative to the paper web 6. Both webs pass through the transfer printing station 5 simultaneously. As a result thereof, both the front side of the paper web 6—in the first pass—as well as its back side are printed due to the turned-over sub-sections 81. The duplex-printed paper 81 is then supplied to further units. Optionally, the web section 6 can already be fixed before the turned-over section is resupplied to the printing station 81. The displacement arrangement with the two detent plates 9 and 9*a* shown in FIG. 3 serves, in particular, for guiding the two web sections lying side-by-side.

The turned-over paper web 81 is coupled into the pre-centering means 8 at the location 72.

Figure 8:
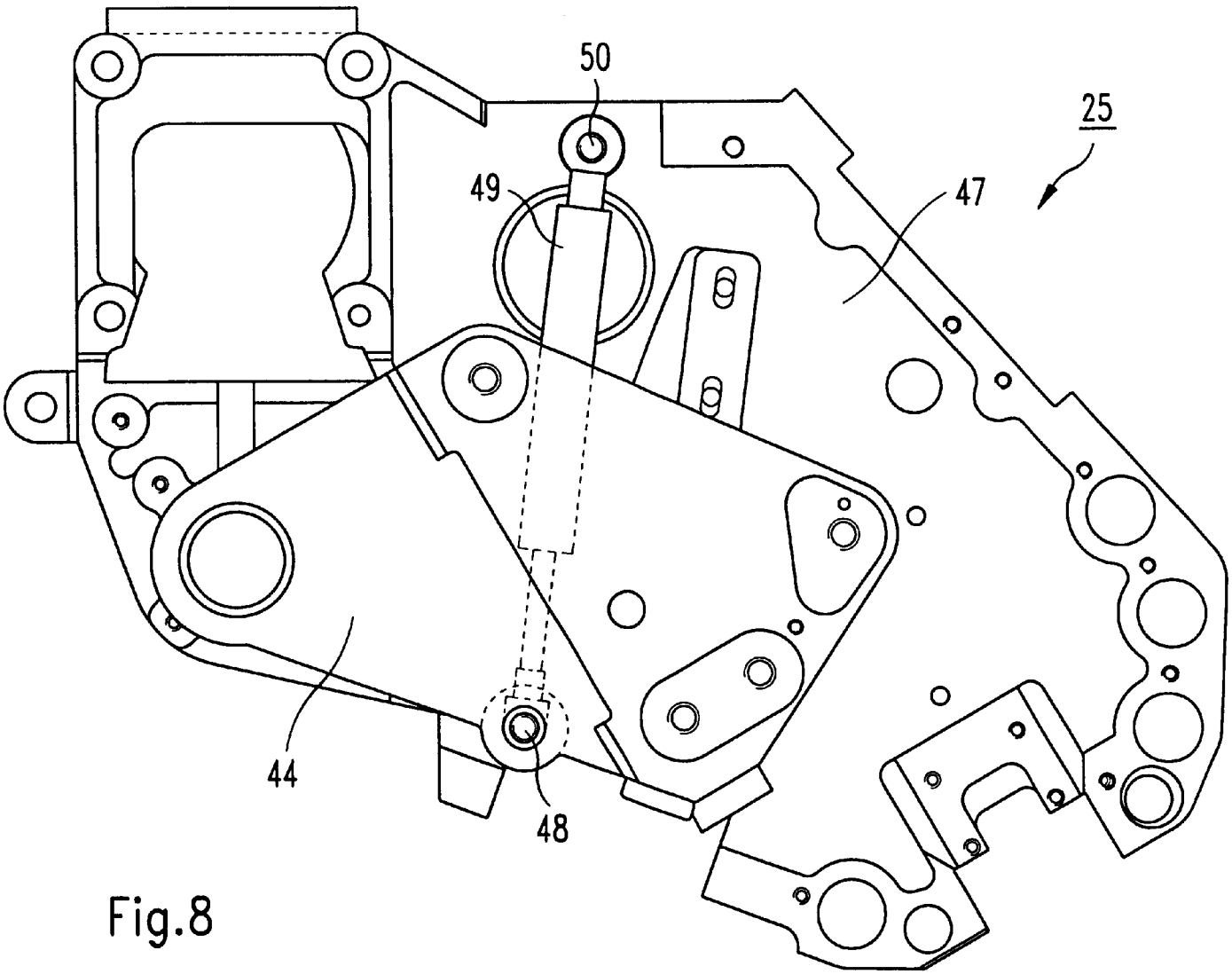
FIG. 8 is a sectional drawing of the paper transport means.

FIG. 8 again shows a sectional view of various components of the paper drive 25, particularly the connection of the carrier plate 47 to the bearing block 44 via the gas compression spring 49 as well as its bearing 48 and 50.

Figure 9:
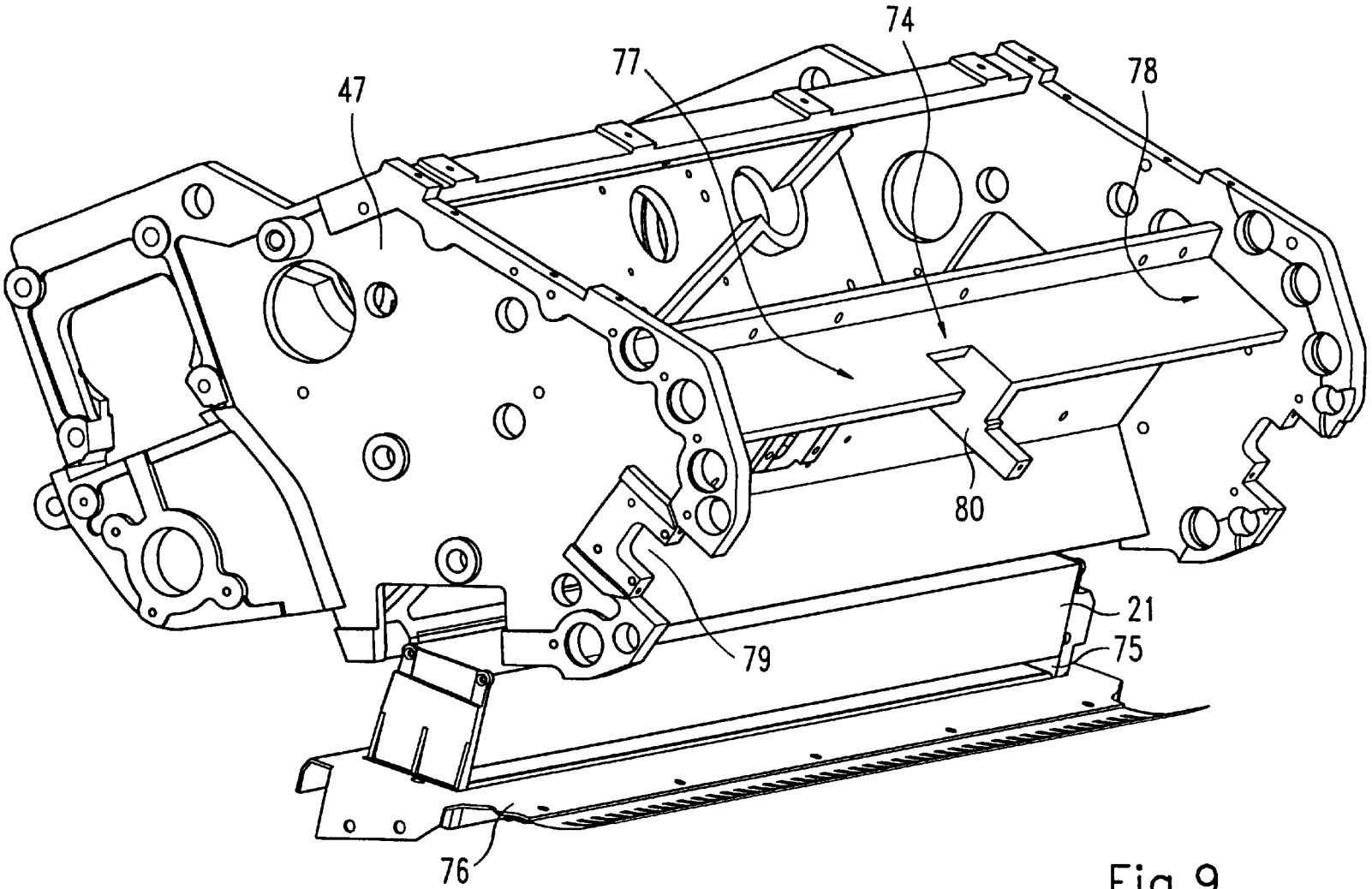
FIG. 9 is a perspective view of the frame of the paper transport means.

FIG. 9 shows the frame of the carrier 47. It is particularly implemented as a cast member. In the illustrated embodiment, a receptacle is provided for a corotron cassette 57. In one embodiment that conducts two parallel paper webs 6 and 6*a* past the transfer printing station, a second receptacle would be provided for the second paper web 6*a*. The first paper web 6 would thereby be transported in the region 77, the second paper web 6*a* in the region 78 of the paper channel 74. The paper width sensor 21 is also shown in FIG. 9. It contains light-emitting diodes and allocated light sensors that sense the paper web 6 or, respectively, both paper webs 6 and 6*a* over the full width. The paper webs 6 and 6*a* are thereby conducted through a gap 75 of the paper width sensor. A guide plate 76 also serves for paper guidance. In one operating mode for processing margin perforated paper 6, the pin feed wheel sensor 85 is additionally utilized, this engaging into the margin perforations of the paper 6, 6*a* and being capable of exactly measuring the position and speed of the paper web 6, 6*a*.

Figure 10:
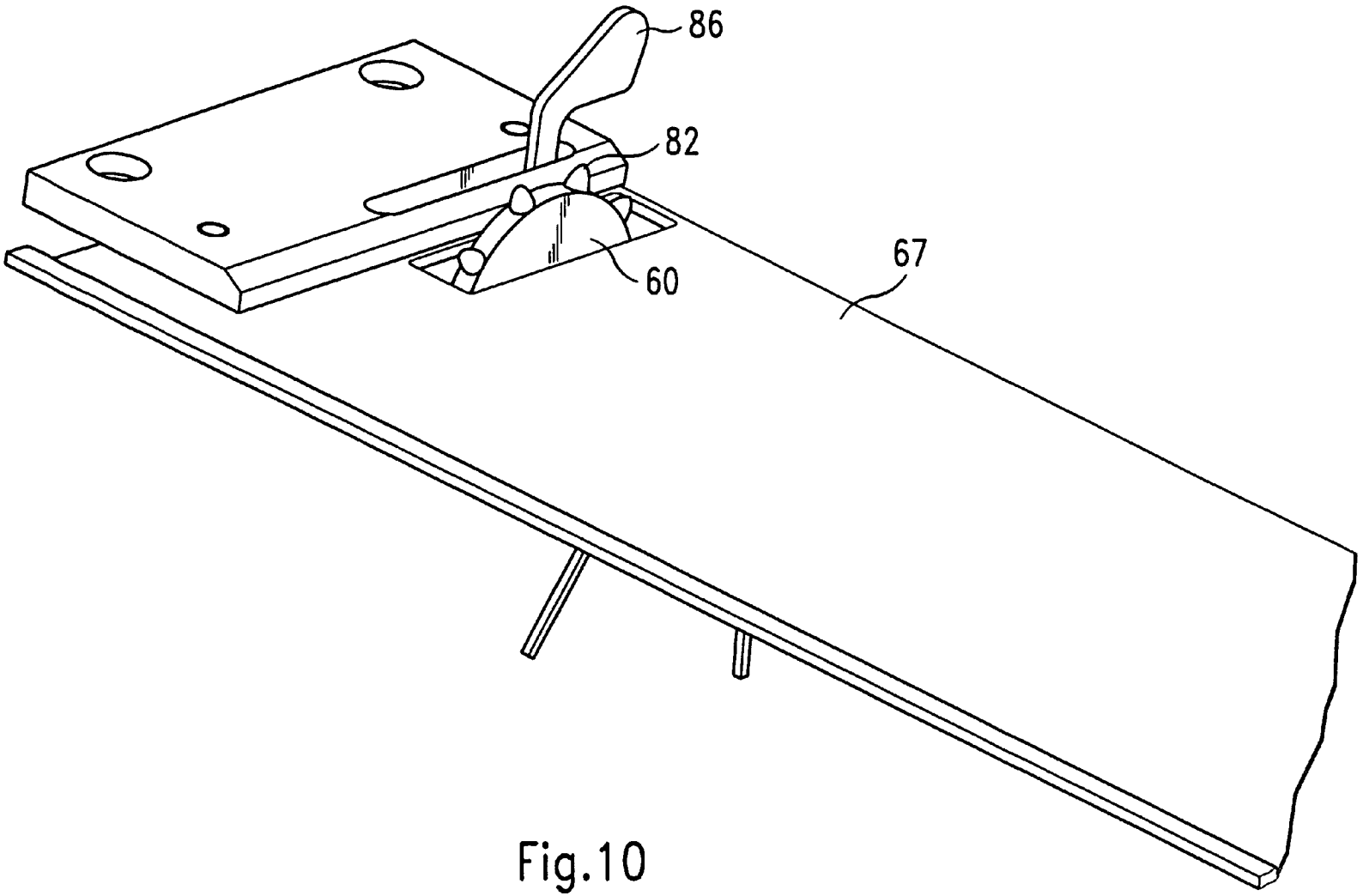
FIG. 10 is a perspective view of a pin feed wheel sensor in the pivoted-in position.

FIG. 10 shows the pin feed wheel in a pivoted-in position, whereby the pins project beyond the paper guidance plane 67. The margin perforations of the paper engage into the pins. This pin feed wheel 60 can be pivoted in or, respectively, out along direction F with an actuation lever 86.

Figure 11:
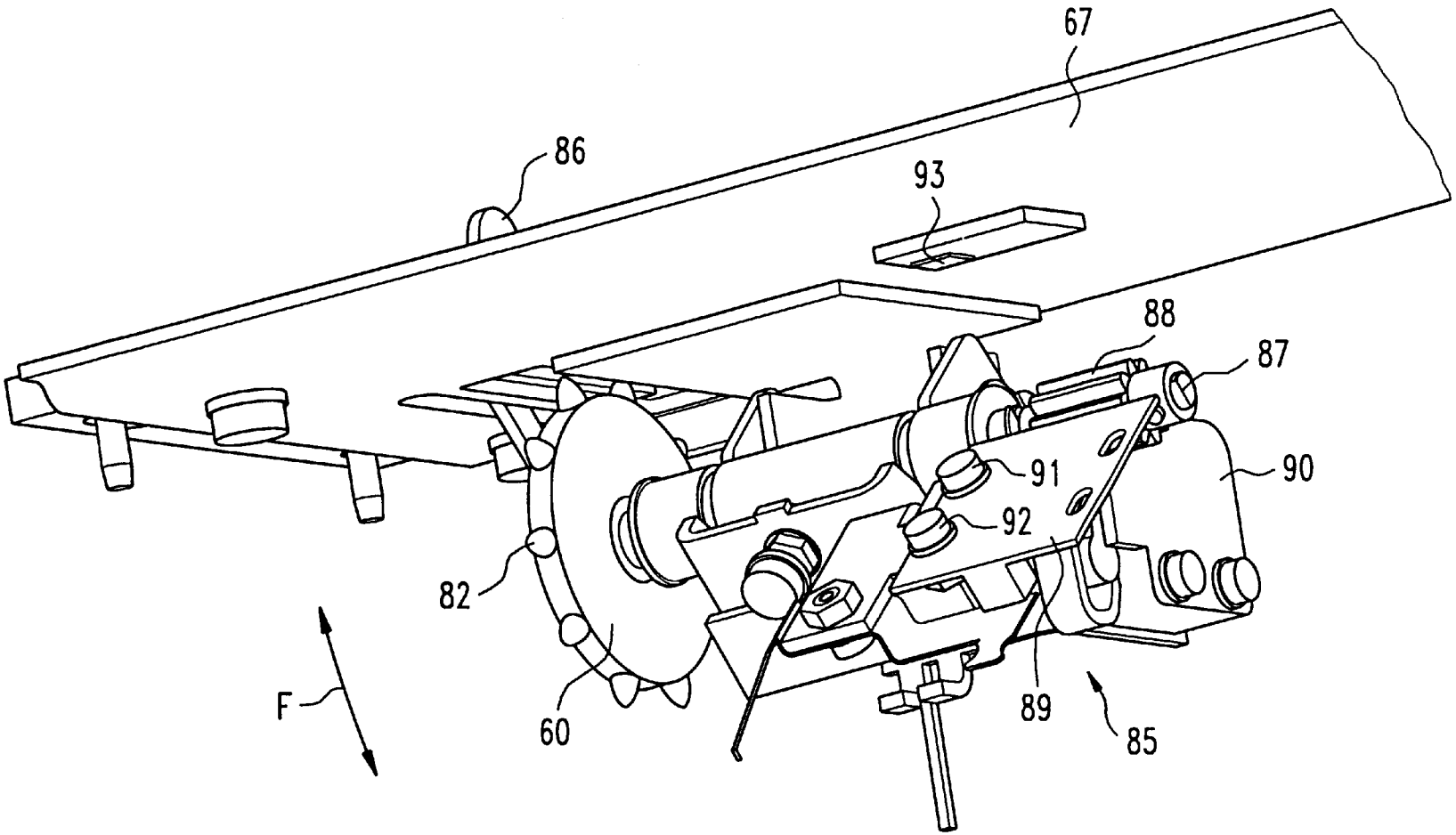
FIG. 11 is a bottom perspective view of the pin feed wheel sensor in the pivoted-out condition.

FIG. 11 shows the pivoted-out position, wherein the pins 82 do not project beyond the surface 67, as well as further details of the pin feed wheel sensor 85. The pin feed wheel 60 is seated on a shaft 87 that likewise carries a gearwheel 88. A magneto-resistive sensor 91 detects pulses of the metal cogs of the gearwheel 88. A second magneto-resistive sensor 92 detects whether the pin feed wheel sensor 85 is in the pivoted-in or pivoted-out position. To this end, it interacts with the magnet 93 that is mounted on the guide surface 67. The sensor assembly is electrically connected to a device controller. The overall pin feed wheel sensor 85 can be locked in the pivoted-out or, respectively, pivoted-in position with a catch mechanism 90.

Figure 12:
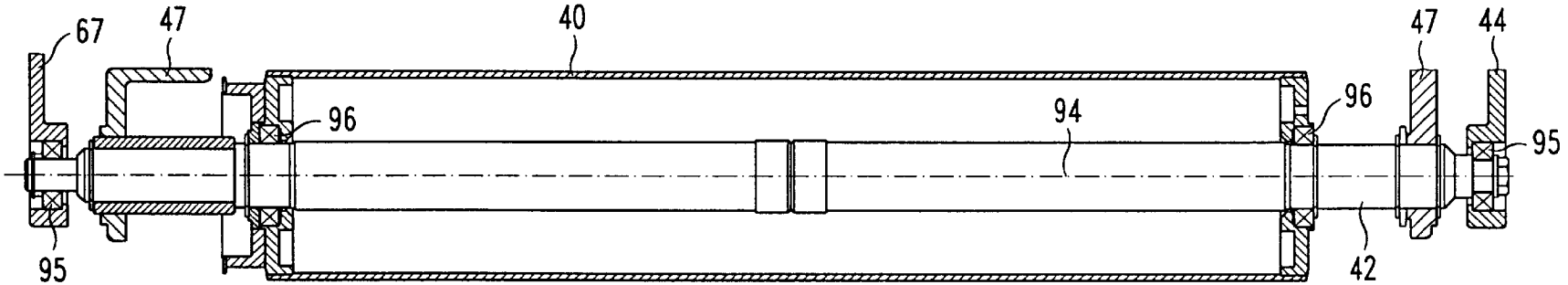
FIG. 12 is a section through a carrier shaft and a drive drum.

FIG. 12 shows the drive shaft 40 and the carrier or bearing shaft 42 of FIGS. 4 through 8 as section along the conveying direction. It can be seen that the carrier shaft proceeds along the axis 94 coaxially with the drive shaft 40. The carrier shaft 42 is respectively seated with a ball bearing 95 in the front and back bearing blocks 44 or, respectively, 67. It lies in the carrier 47 with a clearance fit. The drive shaft 40 is seated on the carrier shaft 42 with ball bearings.

Although other modifications and changes may be suggested by those skilled in the art, it is the intention of the inventors to embody within the patent warranted hereon all changes and modifications as reasonably and properly come within the scope of their contribution to the art.

I claim:

1. An apparatus for transporting a web-shaped recording medium in an electrographic printer or copier device having a housing, comprising:

a carrier carrying a plurality of drive and guide elements, said carrier being pivotably seated at the housing of the printer or copier device via a carrier shaft and being capable of being pivoted back and forth between a working position and a service position;

a drive drum seated at the carrier, the recording medium being transported by said drive drum with friction and a drum proceeding coaxially with the carrier shaft;

contact pressure member with which the recording medium is pressed against a toner transfer means in the transfer printing area of the printer or copier device; and a force transmitting member with which a retaining moment is transmitted onto the recording medium during pivot motion for stabilizing a position of the recording medium relative to the drive drum.

2. An apparatus according to claim 1, further comprising:

a lock mechanism with which the force transmitting member is locked in a working position at the housing of the printer or copier device; and a further member for power support with which the force transmitting member is brought into a service position in an unlocked condition.

3. An apparatus according to claim 2, wherein said further member for power support includes a gas compression spring.

4. An apparatus according to claim 3, wherein the gas compression spring is rotatably seated at the carrier at a first bearing point and at a second bearing point at a bearing block that is rigidly connected to the device housing.

5. An apparatus according to claim 1, further comprising:

a stepping motor driving said drive drum, the stepping motor being under power for exerting retaining moment while the further member is being pivoted from a working position into a service position and back into the working position.

6. An apparatus according to claim 4, wherein the stepping motor is mounted at the carrier.

7. An apparatus according to claim 1, further comprising:

a first adjustable detent provided at the bearing block for adjustment of the means relative to the device housing along a first direction; and a second adjustable detent is provided for adjustment of the means relative to the device housing along a second direction.

8. An apparatus according to claim 1, further comprising:

counter-pressure rollers that press against the drive drum with an adjustable spring force.

9. An apparatus according to claim 1, wherein the drive drum is seated on the carrier shaft.

10. A printer or copier device, comprising:

a carrier carrying a plurality of drive and guide elements, said carrier being pivotably seated at the housing of the printer or copier device via a carrier shaft and being capable of being pivoted back and forth between a working position and a service position;

a drive drum seated at the carrier, the recording medium being transported by said drive drum with friction and a drum proceeding coaxially with the carrier shaft;

a contact pressure member with which the recording medium is pressed against a toner transfer means in the transfer printing area of the printer or copier device; and a force transmitting member with which a retaining moment is transmitted onto the recording medium during pivot motion for stabilizing a position of the recording medium relative to the drive drum.

11. A method for transporting a web-shaped recording medium in an electrographic printer or copier device, comprising the steps of:

providing a carrier carrying a plurality of drive and guide elements, seating said carrier pivotably at the housing of the printer or copier device via a carrier shaft so that said carrier is capable of being pivoted back and forth between a working position and a service position;

providing a drive drum seated at the carrier, transporting the recording medium by said drive drum with friction and said drum proceeding coaxially with the carrier shaft;

pressing the recording medium recording medium against a toner transfer member in a transfer printing area of the printer or copier device; and transmitting a retaining moment onto the recording medium during the pivot motion for stabilizing the position of the recording medium relative to the drive drum.

12. A method according to claim 11, further comprising the step of providing a force transmitting member in either a locked position or an unlocked position.

* * * * *